US009630750B2

(12) United States Patent
Gardner et al.

(10) Patent No.: US 9,630,750 B2
(45) Date of Patent: Apr. 25, 2017

(54) CHILDREN'S STORAGE SOLUTION

(71) Applicant: Lucky Cat Inc. LLC, Arlington, VA (US)

(72) Inventors: Kelly Gardner, Arlington, VA (US); Emily Smith, Pasadena, CA (US); Sebastian Gardner, Arlington, VA (US); Phoebe Gardner, Arlington, VA (US)

(73) Assignee: Lucky Cat Inc. LLC, Arlington, VI (US)

( * ) Notice: Subject to any disclaimer, the term of this patent is extended or adjusted under 35 U.S.C. 154(b) by 0 days.

(21) Appl. No.: 14/704,612

(22) Filed: May 5, 2015

(65) Prior Publication Data

US 2015/0321795 A1 Nov. 12, 2015

Related U.S. Application Data

(60) Provisional application No. 61/990,654, filed on May 8, 2014.

(51) Int. Cl.

| | |
|---|---|
| ***B65D 33/06*** | (2006.01) |
| ***B65D 25/28*** | (2006.01) |
| ***A63H 33/00*** | (2006.01) |
| ***B65D 30/06*** | (2006.01) |
| ***B65D 77/00*** | (2006.01) |

(52) U.S. Cl.

CPC ..... *B65D 33/06* (2013.01); *A63H 33/00* (2013.01); *B65D 25/28* (2013.01); *B65D 29/04* (2013.01); *B65D 77/006* (2013.01)

(58) Field of Classification Search

CPC ..... A44B 19/26; A44B 19/262; A44B 19/42; A01K 1/0254; A45C 3/00; A45C 7/0036; A45C 7/0068; A45C 13/02; A45C 2007/0004; B65D 29/04; B65D 33/02; B65D 33/06

USPC ..... 24/415, 419, 429, 431; 119/482, 119/496–497, 500; 190/125; 206/216, 206/315.1, 579; 220/7, 9.2, 9.4, 481, 220/485; D11/87, 200, 221; D3/276, D3/285, 289; D30/109

See application file for complete search history.

(56) References Cited

U.S. PATENT DOCUMENTS

| | | | | |
|---|---|---|---|---|
| 1,752,111 A * | 3/1930 | Rutherford | ..... | A44B 19/26 24/415 |
| D128,159 S | 7/1941 | Cresap, Jr. | | |
| 2,497,740 A * | 2/1950 | Poux | ..... | A44B 19/262 16/110.1 |
| D234,412 S * | 3/1975 | Swan | ..... | D11/221 |

(Continued)

OTHER PUBLICATIONS http://www.arthritissupplies.com/button-aid-and-zipper-pull.htm/ (accessed Oct. 20, 2015).

(Continued)

*Primary Examiner* — J. Gregory Pickett
*Assistant Examiner* — Brijesh V. Patel
(74) *Attorney, Agent, or Firm* — Koffsky Schwalb LLC; Mark I. Koffsky

(57) ABSTRACT

A storage solution for children's toys is described. A storage and transportation device for children's items (e.g., toys, puzzles, craft supplies, etc.) is specially designed to be used by children, including children under three years old. The storage solution may also include an improved zipper pull for opening and closing the storage and transportation device.

11 Claims, 2 Drawing Sheets

(56) References Cited

U.S. PATENT DOCUMENTS

D254,761 S * 4/1980 Davis ..... D11/221
D304,264 S * 10/1989 Peregrine ..... D3/289
4,928,358 A * 5/1990 Ishii ..... A44B 19/262 24/419
5,090,096 A * 2/1992 Terada ..... A44B 19/262 24/419
D326,248 S * 5/1992 Horita ..... D11/200
D330,113 S 10/1992 Faust
5,170,745 A * 12/1992 Burdette, Jr. ..... A01K 1/0254 119/497
D339,768 S * 9/1993 Takemura ..... D11/221
D368,160 S * 3/1996 Carretta ..... D3/283
D375,835 S * 11/1996 Christopher ..... D3/285
5,676,296 A * 10/1997 Masters ..... A45C 3/001 224/148.7
D389,647 S 1/1998 White
D396,750 S 8/1998 Slater
D398,082 S * 9/1998 Martz ..... D3/273
D398,083 S * 9/1998 Martz ..... D3/273
D411,918 S 7/1999 Neuman
5,941,195 A * 8/1999 Martz ..... A01K 1/0254 119/497
6,021,740 A * 2/2000 Martz ..... A01K 1/0254 119/482
D434,282 S 11/2000 Daw
D435,808 S * 1/2001 Odgard ..... D11/221
6,560,829 B1 * 5/2003 Chen ..... A44B 19/262 24/429
D478,839 S * 8/2003 Yoneoka ..... D11/221
6,652,145 B2 * 11/2003 Valdez ..... A45C 3/08 190/108
D482,987 S * 12/2003 Ritter ..... D11/221
6,668,847 B2 * 12/2003 Zheng ..... A63B 9/00 135/125
D499,667 S * 12/2004 Fenton ..... D11/221
D558,092 S * 12/2007 Lobel ..... D11/221
D560,361 S 1/2008 Huang
D604,045 S 11/2009 Schantz
D639,064 S 6/2011 Raible
8,141,737 B1 3/2012 Tsai
D662,264 S * 6/2012 Chau ..... D30/109
D703,953 S 5/2014 Jusic
D712,144 S 9/2014 Albanese
D718,053 S * 11/2014 McFreen ..... D3/279
D739,655 S 9/2015 Coleman
D767,278 S * 9/2016 Szucs ..... D3/305
2002/0040834 A1 4/2002 Chen
2003/0168453 A1 * 9/2003 Sabounjian ..... A45C 7/0077 220/9.2
2003/0194152 A1 * 10/2003 Peska ..... B65D 33/02 383/40
2004/0089683 A1 * 5/2004 Theodore ..... A45C 13/02 224/153
2005/0155891 A1 * 7/2005 Chen ..... B65D 5/3628 206/524.8
2005/0199625 A1 * 9/2005 Salamone ..... A45C 7/0036 220/9.2
2006/0065500 A1 * 3/2006 Herrig ..... A45C 7/0077 190/107
2008/0066689 A1 * 3/2008 Martz ..... A01K 1/0254 119/497
2009/0077742 A1 * 3/2009 Burns ..... A47D 7/04 5/93.2
2010/0126427 A1 * 5/2010 McGrade ..... A01K 1/0254 119/496
2010/0260441 A1 * 10/2010 Sabounjian ..... A45C 7/0077 383/12
2010/0307649 A1 * 12/2010 Santos Dominguez ..... A45C 13/02 150/107
2011/0155611 A1 * 6/2011 Armstrong ..... A45C 7/0081 206/503
2011/0174811 A1 * 7/2011 Sabounjian ..... D06F 95/002 220/9.2

OTHER PUBLICATIONS http://www.arthritissupplies.com/ring-zipper-pull.html/ (accessed Oct. 20, 2015).
http://www.arthritissupplies.com/zip-grips-zipper-rings.html (accessed Oct. 20, 2015).
http://www.potterybarnkids.com/shop/kids/storage/baskets-boxes-buckets/ (accessed Aug. 17, 2015).
http://www.landofnod.com/nursery-storage/kids-storage-and-shelving/ (accessed Aug. 17, 2015).
http://www.thecompanystore.com/kids-furniture/storage-organization/ (accessed Aug. 17, 2015).
http://www.containerstore.com/shop/toyStorage (accessed Aug. 17, 2015).

* cited by examiner

CHILDREN'S STORAGE SOLUTION

RELATED APPLICATION

This application claims the benefit of the U.S. Provisional Patent Application Ser. No. 61/990,654 filed on May 8, 2014.

FIELD OF THE DISCLOSURE

The present disclosure relates generally to storage solutions for children's toys. In particular, the disclosure relates to a storage and transportation device for children's items (e.g., toys, puzzles, craft supplies, etc.) that is specially designed to be used by children, including children under three years old. The storage solution may also include an improved zipper pull for opening and closing the storage and transportation device.

BACKGROUND

At present, there are limited options for products for the storage and transportation of children's items that have been specifically designed for use by children, including children under three years old.

The current offerings for storage of children's items may be categorized as "baskets", "boxes", "bins" and "drawers." (For illustrative examples, see: http://www.potterybarnkids.com/shop/kids/storage/baskets-boxes-buckets/, http://www.landofnod.com/nursery-storage/kids-storage-and-shelving/, http://www.thecompanystore.com/kids-furniture/storage-orgainization, and http://www.containerstore.com/shop/toyStorage) (all websites referenced herein are as of Apr. 30, 2015).

The current offerings for the transportation of children's items that have been specifically designed for use by children are largely scaled-down tote bags, backpacks and suitcases. (For illustrative examples, see: http://www.potterybarnkids.com/shop/backpacks-luggage/?cm_type=lnav, http://www.landofnod.com/backpacks-and-totes/storage/l and http://www.thecompanystore.com/ck-totes-bags Plastic storage bags, such as disposable Ziploc bags or zippered storage bags that are not designed to be thrown away (e.g., http://www.containerstore.com/shop/storage/storageBags?productId=11001275&N=71237), come in a variety of sizes and are an obvious and easy solution for storing and transporting items, in particular items having multiple parts or pieces. However, such storage bags are neither intended for, nor suitable for, use by children.

Baskets, boxes, bins and drawers do not generally pose a suffocation risk; however, they are usually cumbersome and often heavy, making them difficult for children to lift and carry. Additionally, with the exception of some designs that may include a cover or lid, baskets, boxes, bins and drawers are completely open on the top and are therefore not easily portable. Overall, baskets, boxes, bins and drawers do not incorporate any specific design features that make them particularly useable by children.

Tote bags, backpacks and suitcases may not pose a suffocation risk, and certain tote bags, backpacks and suitcases may incorporate some design features that make them particularly useable by children (e.g., scaled-down handles, large zipper pulls, etc.). However, the user is not able to see through the material from which the bag, backpack or suitcase is made in order to distinguish what's inside, and bags, backpacks and suitcases are generally neither designed for, nor useful for, storing children's items.

Plastic storage bags pose a suffocation risk and are not suitable for use by children. Additionally, they do not incorporate any specific design features that make them particularly useable by children.

In addition to the lack of suitable storage solutions for children, there are few securing mechanisms that allow children to zip or unzip storage solutions.

The current offerings for zipper aids may be categorized as "tools to aid in zippering" and "modified zipper pulls" (For illustrative examples, see http:/www.arthritissupplies.com/button-aid-zipper-pull.html, http:/www.arthritissupplies.com/ring-zipper-pull.html, and http:/www.arthritissupplies.com/zip-grips-zipper-rings.html).

The "tools to aid in zippering" approach is not practical, as the child must have the tool with him or her at all times when assistance with zippering and unzipping is required.

The "modified zipper pulls" approach consists of an "O ring" design, or a slightly modified "O ring" design, that may be attached to an existing zipper pull. The "O ring" design does not aid a user who may not be able to "hook" a finger or a thumb through the "O ring" in order to zip or unzip a zipper.

Accordingly, there is a need in the art for a storage solution that may include a specially-designed zipper pull with design features safely useable by children.

BRIEF DESCRIPTION OF THE FIGURES

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
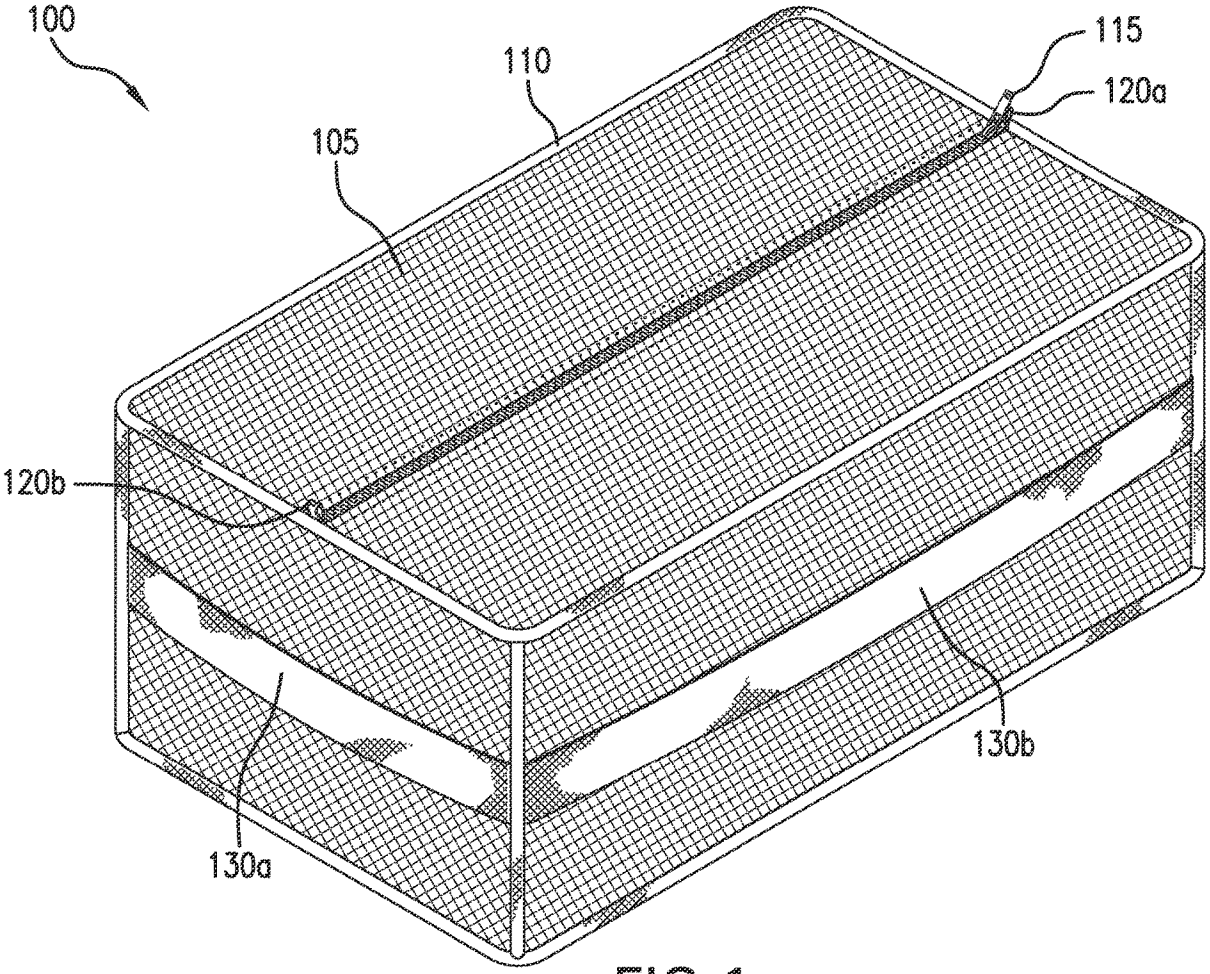
FIG. 1 is a perspective view of an improved storage and transportation device.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

The storage and transportation device and zipper pull described herein may be used separately or together.

I. Storage and Transportation Device

The storage and transportation device (which may be called KINDER CADDY) may be designed to enable children, including children under three years old, to store and transport items having multiple parts or pieces, such as building blocks, that should be kept together.

Turning to FIG. 1, shown is a storage and transportation device 100. The sides and the top of the storage and transportation device may be constructed of a stiff mesh fabric 105 having a tight weave that is breathable and somewhat "see-through" (i.e., it is not transparent, but the contents of the storage and transportation device are largely identifiable through the mesh fabric). The edges 110 of the storage and transportation device may be made of a rigid fabric-covered cording that allows the storage and transportation device to maintain its box shape, even when nothing is inside. There may be a zipper 115 across the entire length of the center of the top of the storage and transportation device and there may be tabs 120*a*, 120*b* sewn at both ends of the zipper mechanism. The storage and transportation device may have two handles: one short handle 130*a* sewn along the short side of the storage and transportation device, and one long handle 130*b* sewn along the long side of the storage and transportation device.

The product includes various design features to make it easy for young children, having small hands and not fully developed dexterity, to use and to carry. To make the product suitable for use by children, and by children under three years old in particular, the product may be constructed of materials that do not pose a suffocation risk and is designed to be in compliance with the "Small Parts Regulations" (16 C.F.R. Part 1501 and 1500.50-53). The product may also be constructed to be durable and designed to be wipe-able.

The standard storage and transportation device may be approximately the size and shape of a shoe box (about 12"×7"×4½"). It may also be offered in additional sizes (e.g., half the size of a shoe box, double the size of a shoe box, a larger version that would be sized to fit underneath a standard crib/toddler bed, etc.).

The storage and transportation device is specifically designed for use by children, including children under three years old, to both store and transport items having multiple parts or pieces, such as building blocks, that should be kept together.

The following features differentiate the storage and transportation device from the current offerings available for the storage and/or transportation of children's items:

1. The storage and transportation device is constructed of a mesh fabric or other breathable fabrics to eliminate the potential for suffocation.

2. The storage and transportation device is designed so that its contents may be seen and identified through the fabric so that the user does not have to open the storage and transportation device in order to see what is inside.

3. The storage and transportation device is deigned to be box-shaped so that it may be stored and stacked on a flat surface, such as a shelf or a table, or in furniture having flat surfaces, such as a bookcase or a drawer.

4. The storage and transportation device is designed to stand-up on its own, maintaining its box shape even when it is not full or when there is nothing inside.

5. The storage and transportation device incorporates two pull-able handles that are strategically positioned to enable children of differing heights to easily carry it without dragging the storage and transportation device on the ground: for taller children, one handle is sewn along the short side of the storage and transportation device, and for shorter children, a second handle is sewn along the long side of the storage and transportation device.

6. The handles also allow children to easily pull the storage and transportation device out from its stored position on a shelf, in a drawer, etc.

7. The handles on the storage and transportation device are designed to be flush with the sides of the storage and transportation device to allow multiple storage and transportation devices to be seamlessly stored side-by-side.

8. The cording on the edges of the storage and transportation device does not incorporate any wire to eliminate the possibility of puncture injuries.

9. The zipper and zipper pull are nonmetallic so as not to cause burns to the skin should the storage and transportation device be left in a hot place such as outside in the sun or in a car.

10. The zipper features a pull that is of a size that is in compliance with the "Small Parts Regulation" (16 C.F.R. Part 1501 and 1500.50-53). As will be discussed below, a zipper pull may be specially designed to allow for easy grasping and pulling by small hands having limited dexterity.

11. There may be two tabs, one sewn at each end of the zipper, to allow for easy zipping and unzipping by small hands having limited dexterity.

12. The storage and transportation device is constructed to be light weight.

13. The storage and transportation device is constructed with materials that are durable.

14. The storage and transportation device is constructed with all non-toxic materials that are safe for children (e.g., no bisphenol A (BPA), polyvinyl chloride (PVC) or phthalates).

15. The storage and transportation device is wipe-able—it may be cleaned using a wet cloth or sponge with or without soap.

16. The storage and transportation device is designed to be reusable, as well as repurposed.

II. Zipper Pull

The zipper pull (which may be called KINDER ZIP) is specifically designed to enable people who have limited dexterity in or use of their hands (e.g., due to injury or a condition such as arthritis), as well as children having small hands and not fully developed dexterity, to zip and unzip a zipper.

Figure 2:
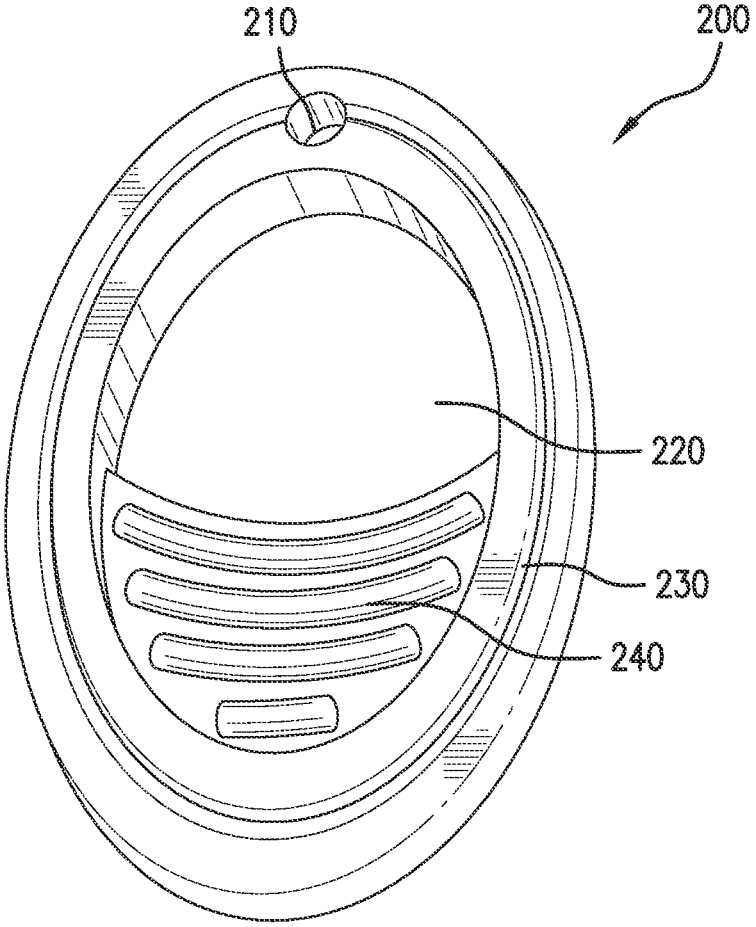
FIG. 2 is a perspective view of an improved zipper pull.

Turning to FIG. 2, shown is a zipper pull 200. The zipper pull is an elliptical shape and may have a minor diameter measuring approximately 1¼" and a major diameter measuring approximately 2". The zipper pull is "hollowed", thus having an open center 220. The bottom end of the hollowed center of the zipper pull incorporates a horseshoe-shaped grip 240 that is textured with finger tread. The zipper pull may include a grooved indentation 230 around its circumference. A small hole 210 is drilled at the top of the zipper pull to allow for the attachment of a fastener (such as a zipper). Further, the features on the front of the zipper pull are mirrored on the back of the zipper pull.

The zipper pull is specifically designed to aid people who have limited dexterity in or use of their hands, including children under three years old, in zipping and unzipping a zipper. The following features differentiate the zipper pull from the current zippering aid offerings available:

1. The overall shape of the zipper pull is specifically designed to enable users to easily find, without looking, the appropriate finger positions for pulling the zipper pull to zip or unzip a zipper.

2. The elliptical shape of the zipper pull incorporates a circumferential grooved body that provides additional textural cues to fingers.

3. The zipper pull features a grip that incorporates finger tread to enable the user to easily grasp the zipper pull with a finger and thumb, and to enable the user to maintain the grasp, while zipping or unzipping a zipper.

4. The zipper pull features an opening that enables the user to "hook" a finger or thumb around the zipper pull to zip or unzip a zipper, thus allowing a user who may not be able to use the grasp feature due to a hand injury or condition or due to wearing gloves or mittens, to be able to zip or unzip a zipper.

5. The zipper pull is of a size that is in compliance with the "Small Parts Regulation" (16 C.F.R. Part 1501 and 1500.50-53).

6. The zipper pull is nonmetallic so as not to cause burns to the skin should the item incorporating the zipper pull be left in a hot place such as outside in the sun or in a car.

7. The zipper pull is constructed from all nontoxic materials that are safe for children (e.g., no bisphenol A (BPA), polyvinyl chloride (PVC) or phthalates).

8. The zipper pull allows for the attachment of a fastener that permits it to be affixed to existing zipper pulls.

9. The zipper pull is designed to be removable and reusable.

10. The zipper pull is constructed to be light weight with materials that are durable and washable.

11. The zipper pull is constructed with materials that are washable.

In the foregoing specification, specific embodiments have been described. However, one of ordinary skill in the art appreciates that various modifications and changes can be made without departing from the scope of the invention as set forth herein. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A storage device comprising:

a top portion, a bottom portion, a left portion, a right portion, a front portion and a rear portion forming a storage device interior;

a front-left edge securing the front portion with the left portion;

a front-right edge securing the front portion with the right portion;

a rear-left edge securing the rear portion with the left portion;

a rear right edge securing the rear portion with the right portion;

a top-left edge securing the top portion with the left portion;

a top-right edge securing the top portion with the right portion;

a top-front edge securing the top portion with the front portion;

a top-rear edge securing the top portion with the rear portion;

a bottom-left edge securing the bottom portion with the left portion;

a bottom-right edge securing the bottom portion with the right portion;

a bottom-front edge securing the bottom portion with the front portion;

a bottom-rear edge securing the bottom portion with the rear portion;

a connecting system running in a straight line from the top-left edge to the top-right edge substantially bisecting the top portion into a first half top portion and a second half top portion;

a first handle secured at the rear-left edge and secured at the front-left edge;

a second handle secured at the front-left edge and secured at the front-right edge;

a first tab secured to the top-left edge and a second tab secured to the top-right edge;

wherein each of the top portion, the left portion, the right portion, the front portion and the rear portion comprises mesh fabric;

wherein each of the front-left edge, the front-right edge, the rear-left edge, the rear-right edge, the top-left edge, the top-right edge, the top-front edge, the top-rear edge, the bottom-left edge, the bottom-right edge, the bottom-front edge and the bottom-rear edge substantially maintains the shape of the storage device interior when the storage device interior is empty;

wherein the connecting system comprises a zipper slider running from the top left edge to the top right edge substantially bisecting the top portion and a zipper pull, wherein when the zipper pull is pulled through the zipper slider, the first half top portion and the second half top portion disconnect and allow access to the storage device interior;

wherein the mesh fabric, the front-left edge, the front-right edge, the rear-left edge, the rear-right edge, the top-left edge, the top-right edge, the top-front edge, the top-rear edge, the bottom-left edge, the bottom-right edge, the bottom-front edge, the bottom-rear edge, the first handle, the second handle and the connecting system all comprise materials safe for use by children.

2. The storage device as in claim 1, wherein the mesh fabric is woven such that it is partially transparent.

3. The storage device as in claim 1, wherein each of the front-left edge, the front-right edge, the rear-left edge, the rear-right edge, the top-left edge, the top-right edge, the top-front edge, the top-rear edge, the bottom-left edge, the bottom-right edge, the bottom-front edge and the bottom-rear edge comprises materials other than wire.

4. The storage device as in claim 1, wherein the second handle is substantially longer than the first handle.

5. The storage device as in claim 4, wherein the first handle is substantially flush with the left portion and second handle is substantially flush with the front portion.

6. A storage device comprising:

a top portion, a bottom portion, a left portion, a right portion, a front portion and a rear portion forming a storage device interior;

a front-left edge securing the front portion with the left portion;

a front-right edge securing the front portion with the right portion;

a rear-left edge securing the rear portion with the left portion;

a rear right edge securing the rear portion with the right portion;

a top-left edge securing the top portion with the left portion;

a top-right edge securing the top portion with the right portion;

a top-front edge securing the top portion with the front portion;

a top-rear edge securing the top portion with the rear portion;

a bottom-left edge securing the bottom portion with the left portion;

a bottom-right edge securing the bottom portion with the right portion;

a bottom-front edge securing the bottom portion with the front portion;

a bottom-rear edge securing the bottom portion with the rear portion;

a substantially flat elliptical body having a front side and a rear side and having a circumference section and a center section, wherein the circumference section comprises a circumferential groove on the front side, a circumferential groove on the rear side and a first hole through a portion of the circumference section;

wherein the center section comprises a gripping mechanism and a second hole through a substantial portion of the center section, and wherein the gripping mechanism comprises at least one ridge on the front side and at least one ridge on the rear side;

a zipper slider running in a straight line from the top left edge to the top right edge substantially bisecting the top portion and a zipper pull, wherein when the zipper pull is pulled through the zipper slider, the top portion bisects and allows access to the storage device interior, wherein the zipper pull is mechanically engaged with the first hole;

a first handle secured at the rear-left edge and secured at the front-left edge;

a second handle secured at the front-left edge and secured at the front-right edge;

a first tab secured to the top-left edge and a second tab secured to the top-right edge;

wherein each of the top portion, the left portion, the right portion, the front portion and the rear portion comprises mesh fabric;

wherein each of the front-left edge, the front-right edge, the rear-left edge, the rear-right edge, the top-left edge, the top-right edge, the top-front edge, the top-rear edge, the bottom-left edge, the bottom-right edge, the bottom-front edge and the bottom-rear edge substantially maintains the shape of the storage device interior when the storage device interior is empty;

wherein the mesh fabric, the front-left edge, the front-right edge, the rear-left edge, the rear-right edge, the top-left edge, the top-right edge, the top-front edge, the top-rear edge, the bottom-left edge, the bottom-right edge, the bottom-front edge, the bottom-rear edge, the first handle, the second handle, the substantially flat elliptical body, the zipper pull and the zipper slider are all comprised of materials safe for use by children.

7. The storage device as in claim 6, wherein the mesh fabric is woven such that it is partially transparent.

8. The storage device as in claim 6, wherein each of the front-left edge, the front-right edge, the rear-left edge, the rear-right edge, the top-left edge, the top-right edge, the top-front edge, the top-rear edge, the bottom-left edge, the bottom-right edge, the bottom-front edge and the bottom-rear edge comprises materials other than wire.

9. The storage device as in claim 6, wherein the second handle is substantially longer than the first handle.

10. The storage device as in claim 9, wherein the first handle is substantially flush with the left portion and second handle is substantially flush with the front portion.

11. The storage device as in claim 6, wherein the substantially flat elliptical body is in compliance with small parts regulations in Title 16 of the Code of Federal Regulations, Part 1501 in effect on May 5, 2015.

* * * * *